US007533778B1

(12) United States Patent
Staples

(10) Patent No.: US 7,533,778 B1
(45) Date of Patent: May 19, 2009

(54) MANWAY OPENER SYSTEM AND METHOD

(76) Inventor: Wesley A. Staples, 4095 Silver Lake Dr., Palatka, FL (US) 32177-7978

( * ) Notice: Subject to any disclaimer, the term of this patent is extended or adjusted under 35 U.S.C. 154(b) by 538 days.

(21) Appl. No.: 11/181,034

(22) Filed: Jul. 13, 2005

Related U.S. Application Data

(60) Provisional application No. 60/588,133, filed on Jul. 15, 2004.

(51) Int. Cl.
*B66C 11/12* (2006.01)

(52) U.S. Cl. ..... 212/166; 141/256; 141/360; 49/324; 49/356; 414/414; 220/211

(58) Field of Classification Search ..... 141/2, 141/256, 351, 360; 29/255, 252; 254/89 H, 254/3 R, 103; 49/506, 324, 356, 630, 360; 414/642, 680, 411, 414, 519; 212/287, 341, 212/166; 220/211, 244, 820, 262
See application file for complete search history.

(56) References Cited

U.S. PATENT DOCUMENTS

| | | | | | |
|---|---|---|---|---|---|
| 1,190,036 | A | | 7/1916 | Stauft | |
| 1,615,878 | A | * | 2/1927 | Laird | 49/340 |
| 3,281,880 | A | | 11/1966 | Bender | |
| 3,385,469 | A | | 5/1968 | Gaines | |
| 4,126,520 | A | | 11/1978 | Horster | |
| 4,148,401 | A | | 4/1979 | Kautetzky | |
| 4,225,393 | A | | 9/1980 | Gregor et al. | |
| 4,297,072 | A | | 10/1981 | Shah et al. | |
| 4,307,753 | A | * | 12/1981 | Dryer | 138/30 |
| 4,313,709 | A | | 2/1982 | Herman | |
| 4,360,310 | A | | 11/1982 | Kost | |
| 4,398,649 | A | | 8/1983 | Labbe | |
| 4,430,002 | A | | 2/1984 | Dongelmans | |
| 4,560,283 | A | | 12/1985 | Eirich et al. | |
| 4,664,586 | A | | 5/1987 | Vassalotti | |
| 4,734,998 | A | * | 4/1988 | Lee et al. | 34/482 |
| 4,865,513 | A | | 9/1989 | Norris | |
| 4,960,358 | A | | 10/1990 | DiGiacomo et al. | |
| 5,007,590 | A | * | 4/1991 | Taylor | 241/25 |
| 5,035,336 | A | | 7/1991 | Schmitz et al. | |
| 5,038,520 | A | | 8/1991 | Amorese et al. | |
| 5,284,578 | A | | 2/1994 | Tobler et al. | |
| 5,336,375 | A | | 8/1994 | Wallskog et al. | |
| 5,617,963 | A | * | 4/1997 | Baziuk et al. | 212/179 |
| 6,264,829 | B1 | | 7/2001 | Antalffy et al. | |
| 2001/0044986 | A1 | | 11/2001 | Wilkins | |

* cited by examiner

*Primary Examiner*—Timothy L Maust
*Assistant Examiner*—Jason K Niesz
(74) *Attorney, Agent, or Firm*—Allen, Dyer, Doppelt, Milbrath & Gilchrist, P.A.

(57) ABSTRACT

A cover secured to an opening in a tank may be safely removed by controlling a flow of material stored within the tank through the opening. A remotely controlled actuator is carried by a frame and attached near the opening. An arm connected to the actuator engages the cover for providing sufficient force against the cover for preventing the cover from being dislodged so that the cover may be unsecured. The actuator is then remotely controlled for safely moving the cover from a closed position to an open position for controlling a flow of material from the tank. A guide may be employed for guiding the cover longitudinally outward from the opening along the arm.

25 Claims, 4 Drawing Sheets

MANWAY OPENER SYSTEM AND METHOD

CROSS-REFERENCE TO RELATED APPLICATIONS

This application claims the benefit of U.S. Provisional Application No. 60/588,133, filed Jul. 15, 2004, the disclosure of which is hereby incorporated herein by reference in its entirety.

FIELD OF THE INVENTION

The present invention generally relates to liquid storage tank cleaning, and in particular to a safe removal of solids buildup material through a tank manway door.

BACKGROUND OF THE INVENTION

In numerous industries today we are very dependant upon above ground storage tanks (AGS tanks). In addition to being a temporary holding vessel for finished products many process fluids reside in these tanks. In many instances we find that the tank bottoms accumulate and build up solids to substantial levels as the solids precipitate out of the stored liquids. At times these levels exceed the level of manway door openings that are normally used to access the tank for cleaning and inspection. These elevated levels of solids above the manway door opening present a special safety problem when the tank is being cleaned. At times solids will have built-up around the doorway opening and when the manway door is removed, the solids will set for a short period of time before liquids in the tank break through and spill outside the tank, typically into a tank moat area. Personnel in the mote area can become engulfed in the liquid that may be hot, acidic, or caustic. This is the unfortunate result of some tank openings that cause critical injury and death. Such cases are well documented.

SUMMARY OF THE INVENTION

In an effort to prevent occurrences as above described, by way of example, the present invention is directed to a manual and power controlled door opener adapted to any shape doorway. Responsible companies will want to adopt this system to prevent injury and possibly death to workmen and contractors having to deal with typical cleaning of large storage tank structures.

A method aspect of the invention may include removing a cover secured about an opening in a tank for safely controlling a flow of material stored within the tank through the opening. The method may comprise positioning a frame proximate the opening, attaching an actuator to the frame, and extending an arm between the frame and the cover. A proximal end of the arm is connected to the actuator and a distal end of the arm connected to the cover. The actuator is then operated for forcing the arm against the cover with sufficient force for preventing the cover from being dislodged from about the opening so that the cover may be unsecuring the cover from about the opening. As a result, the actuator may be controlled for moving the cover from a closed position to an open position through a spacing therewith, wherein a distance for the spacing controls the flow of material from the tank. Alternatively, a guide element may be employed for operably guiding the cover longitudinally outward from the opening along the arm.

In yet another method of removing a manway cover from a flange extending about an opening in a storage tank, wherein the manway cover is secured to the flange by a plurality of pegs extending through apertures in the cover for securing the cover to the flange, the method may comprise removing a first portion of the plurality of pegs for exposing first apertures therein while maintaining the cover secured to the flange and rigidly attaching a frame to the flange using the first apertures for a fastening therewith. An actuator may then be attached to the frame and an arm operably connected for engagement between the cover and the actuator for operating the actuator for providing sufficient force against the manway cover for preventing the manway cover from being dislodged from the flange. A second portion of the plurality of pegs is also removed for exposing second apertures for securing at least two guide pins to the flange for movement through the second apertures for guiding a removing of the manway cover therealong. The balance of the plurality of pegs is then removed for moving the cover from a closed position to an open position through a spacing therewith longitudinally outward along the guide pins, wherein spacing the cover from the flange and thus the opening controls the flow of material through the opening.

In addition to the remote controlled door opener embodiment as a stand-alone unit it may be coupled with a system for fluidizing the sludge as it flows out of the tank. After fluidizing, the sludge may be pumped to other tanks or storage, by way of example. One system may control material as it exits a shell manway. The sludge may be processed through a chopper to eliminate large lumps that are typically present in sludge. By moving the sludge out of a containment box with an auger, the processed sludge material may be further conditioned. It may be pumped directly or a "muncher" may be used to provide additional breakdown of particle size to the solids. Fluids may be added as desired.

By way of example, embodiments of the present invention allow a plant facility to provide an entire tank cleaning without placing people in the tank. The present invention allows work to be completed while the tank is in use. Re-circulation may be done as well. Those of skill in the art will appreciate that for tanks such as white liquor tanks, typically used in the pulp and paper industry, it may be desirable to keep one system in place on the tank for the removal of lime mud. The present invention provides embodiments that provide value to industrial contractors, plant maintenance and operations, and the like.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE PREFERRED EMBODIMENTS

The present invention will now be described more fully hereinafter with reference to the accompanying drawings, in which embodiments of the invention are shown, by way of example. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Embodiments of the invention may include a remotely controlled manway door opener, a storage and removal apparatus for undesirable tank solids, and a combination thereof. By way of example, one embodiment of the remote controlled door opener may include a frame having a hydraulic cylinder and shaft arm operable with a plate to be affixed to the manway door for an opening and closing thereof using elongate rods for guiding and securing the door. Containment of material removed from the tank through the manway door may be collected within an enclosure or tray, wherein a chopper assembly and auger provide for the processing of the material and transport away from the tank.

Figure 1:
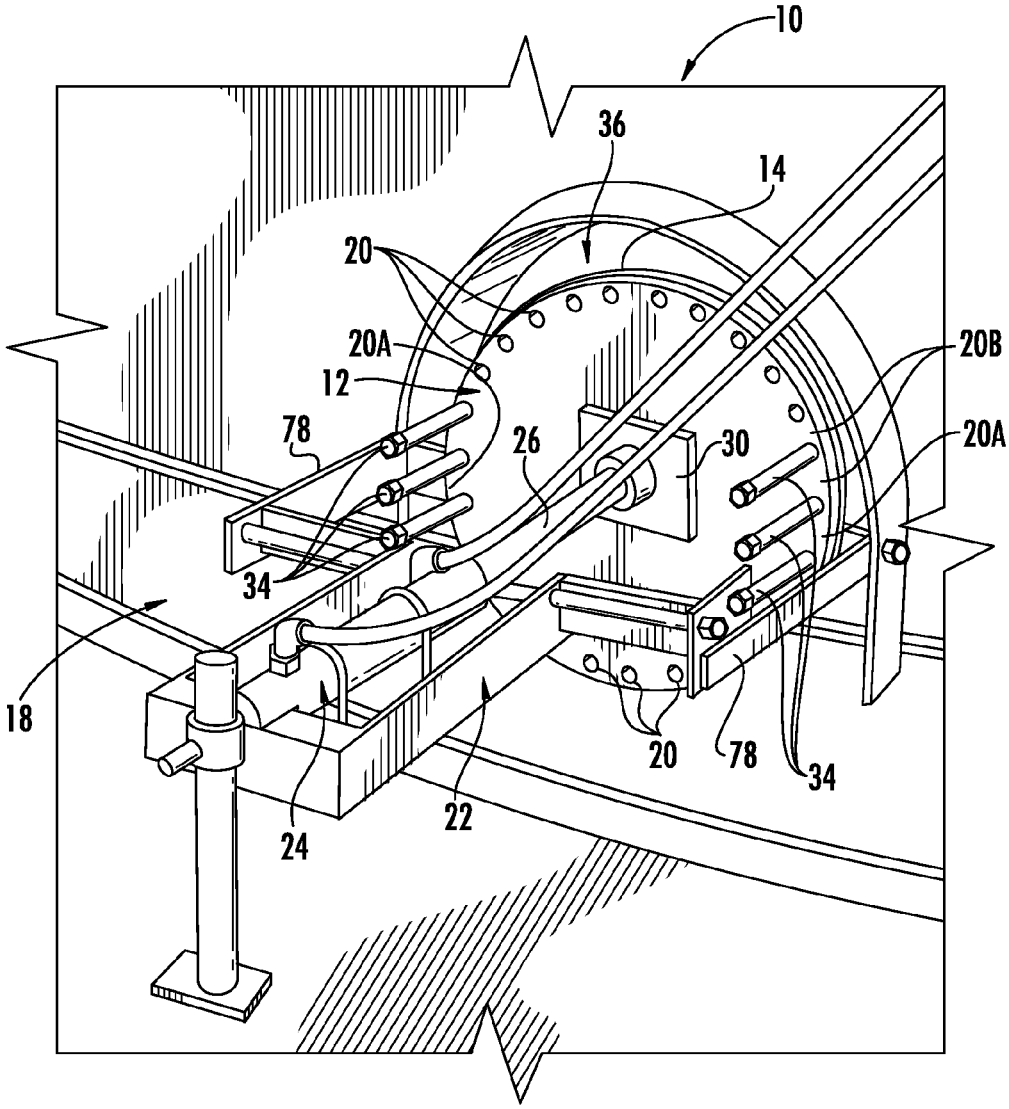
FIG. 1 is a perspective view of one embodiment of a manway tank door opening system in keeping with the teachings of the present invention.
Figure 2:
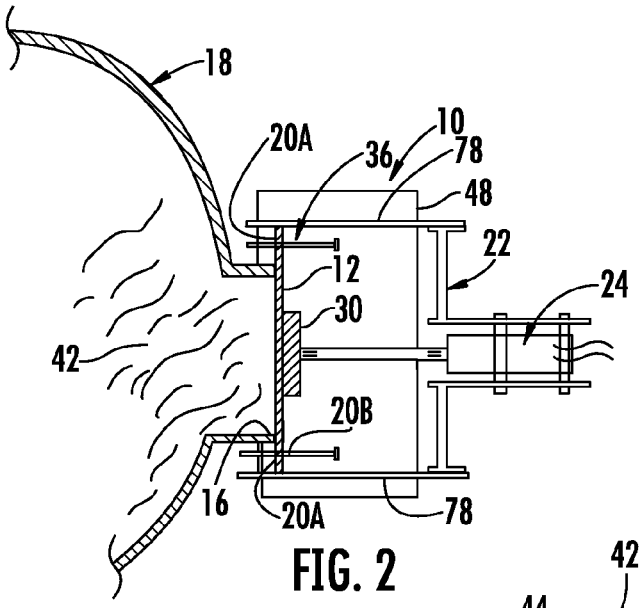
FIG. 2 is a partial top view illustrating an alternate embodiment of the invention.
Figure 3:
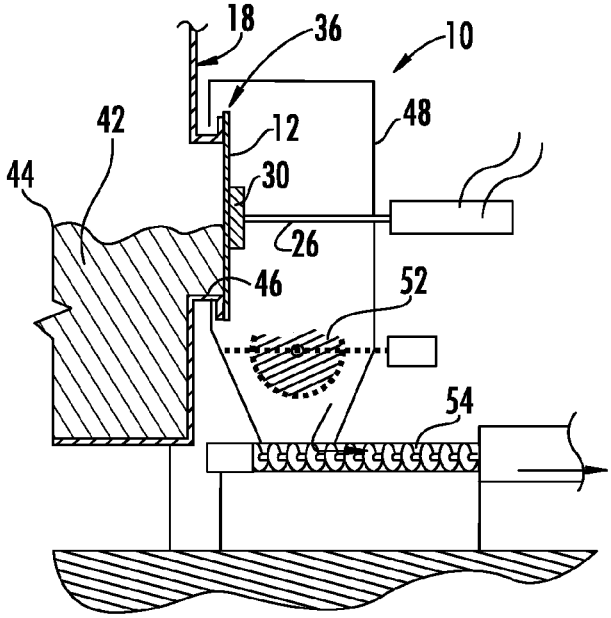
FIGS. 3 and 3A are partial elevation diagrammatical views of an alternate embodiment of the invention illustrating a controlled opening of a manway door.

Referring initially to FIGS. 1,2 and 3, a system 10 and method of removing a manway cover 12 from a flange 14 extending about an opening 16 in a storage tank 18 is herein described, by way of example, for an embodiment of the invention. For the example illustrated, the manway cover 12 is secured to the flange 14 by a plurality of pegs 20 extending through apertures in the cover for securing the cover to the flange. One method may comprise removing a first portion 20A of the plurality of pegs for exposing first apertures therein while maintaining the cover 12 secured to the flange 14 and then rigidly attaching a frame 22 to the flange using the first apertures for fastening the frame to the flange. Alternatively, the frame 22 may be secured to a surface upon which the tank 18 is carried, by way of example, wherein a rigid engagement of the frame to the tank may result.

With continued reference to FIGS. 1 and 2, and for the embodiment herein described by way of example, a connection between the flange 14 and the frame 22 is provided. As illustrated with reference again to FIGS. 1 and 2, an actuator 24 is carried by the frame 22. An arm 26 operable with the actuator engages the cover 12. In one embodiment, a distal end 28 may be attached to a plate 30, and the plate welded to the cover 12. The actuator 24, herein described for hydraulic or pneumatic operation through control lines 32, is then operated for providing sufficient force against the manway cover 12 for preventing the manway cover from being dislodged from the flange 14, even with all of the pegs removed, by way of example.

With continued reference to FIGS. 1 and 2, in one embodiment, a second portion 20B of the plurality of pegs for exposing second apertures. Guide pins 34 are then connected to the flange 14 for movement through the second apertures for guiding a removing of the manway cover 12. Removing a balance of the plurality of pegs then allows the actuator 24 to move the cover 12 from a closed position 36, as illustrated with reference to FIGS. 1-3, to an open position 38, as illustrated with reference to FIG. 3A, resulting in a spacing 40, wherein spacing the cover 12 from the flange 14 and thus the opening 16 permits a controlling of a flow of material 42 through the opening.

Figure 3A:
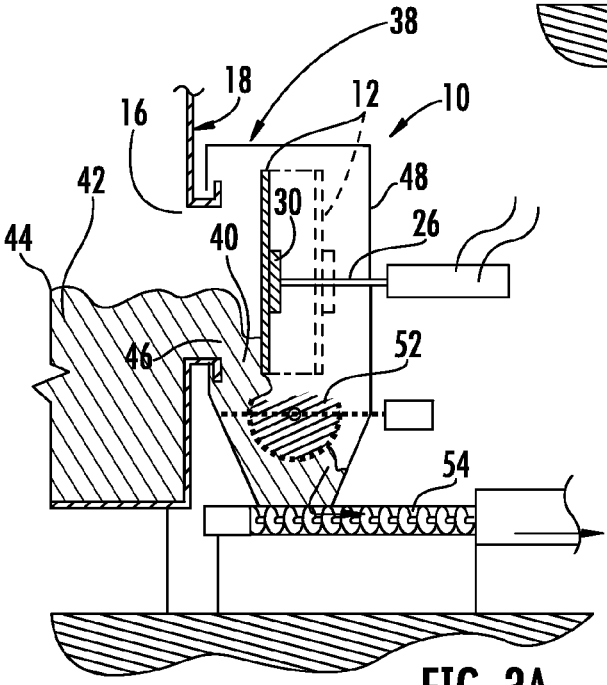

One skilled in the art of tank cleaning will appreciate the value and safety provided with such a system and method, when realizing that the material 42 remaining in the tank 18 is at a level 44 above the opening lower level 46, as illustrated by way of example with reference to FIGS. 3 and 3A.

Figure 4:
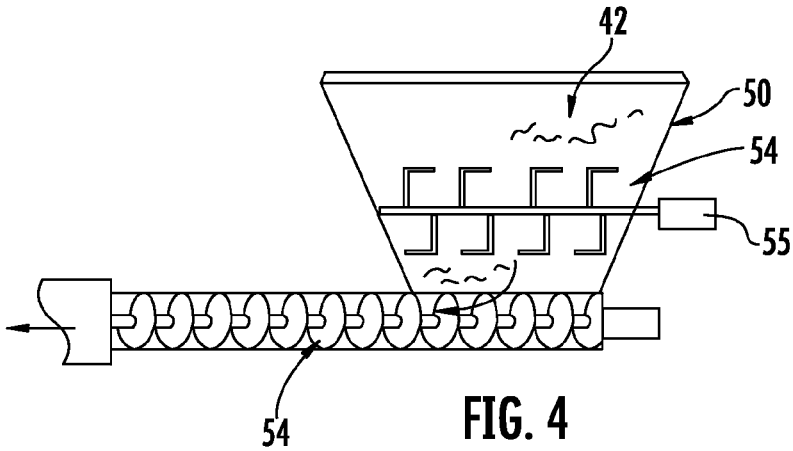
FIG. 4 is a partial diagrammatical view illustrating a material removal portion of et system of FIG. 3.

With reference again to FIGS. 2 and 3, a containment shield 48 may be employed and extended about the flange 14 for confining the material 42 passing through the opening 16. In one embodiment, a container 50, such as a tray, may be employed for collecting the material 42 flowing from the tank 18 through the opening 16. The material 42 may then be processed for improving its fluid flow for further pumping container 50. As herein described, by way of example, the processing may include chopping the material by using a grinder 52 before pumping the processed material. Pumping may employ an auger 54 as illustrated, by way of example, with reference to FIG. 4 and again to FIG. 3. An electric, hydraulic, or the like motor 55 may be employed to drive the auger 54.

As will be understood by those skilled in the art, the system 10 may include other material removal devices now having benefit of the teachings of the present invention. Yet further, the material 42 may be allowed to spill from the opening 16 without being captured.

Figure 5A:
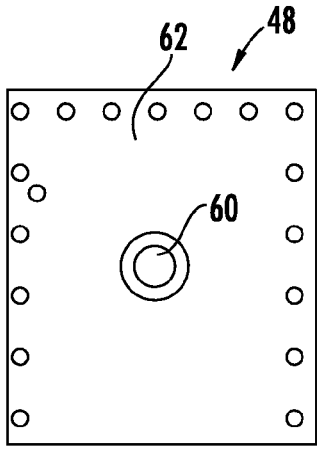
FIGS. 5A, 5B, and 5C are partial views of forward, rear, and side panels of one embodiment of a containment shield.
Figure 5B:
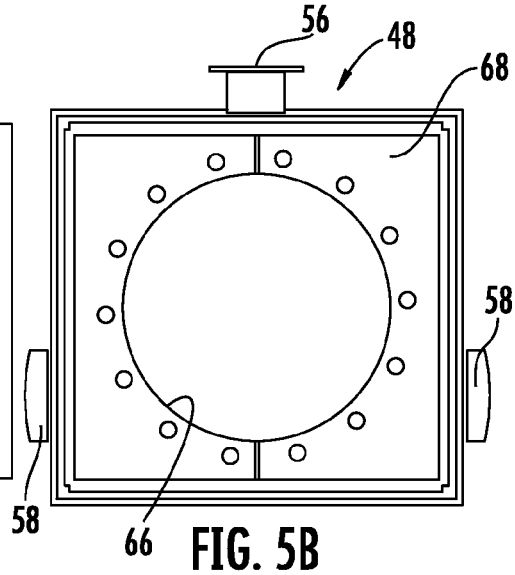
Figure 5C:
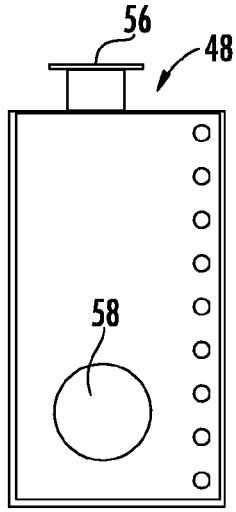

By way of example, and with reference to FIGS. 5A, 5B, and 5C, one embodiment of the containment shield 48 may include an access port 56 and cleanout ports 58 for providing access into the containment shield 48. For embodiments where the actuator 24 is carried outside the containment shield 48, as earlier illustrated by way of example with reference to FIGS. 2 and 3, an aperture 60 is provided in one side panel 62. Further, and as illustrated with reference again to FIG. 5B, hole 64 are provided about an opening 66 in panel 68 for receiving pegs or the guide pins 34 earlier described, when securing the panel 68 to a tank side surface of the flange 14. Additional holes 70 may be positioned about the peripheral portions of the containment shield side panels for ease in assembling the shield on site, by way of example. Tapped angle iron 72 may also be used to attaché the side panels to each other.

Figure 6:
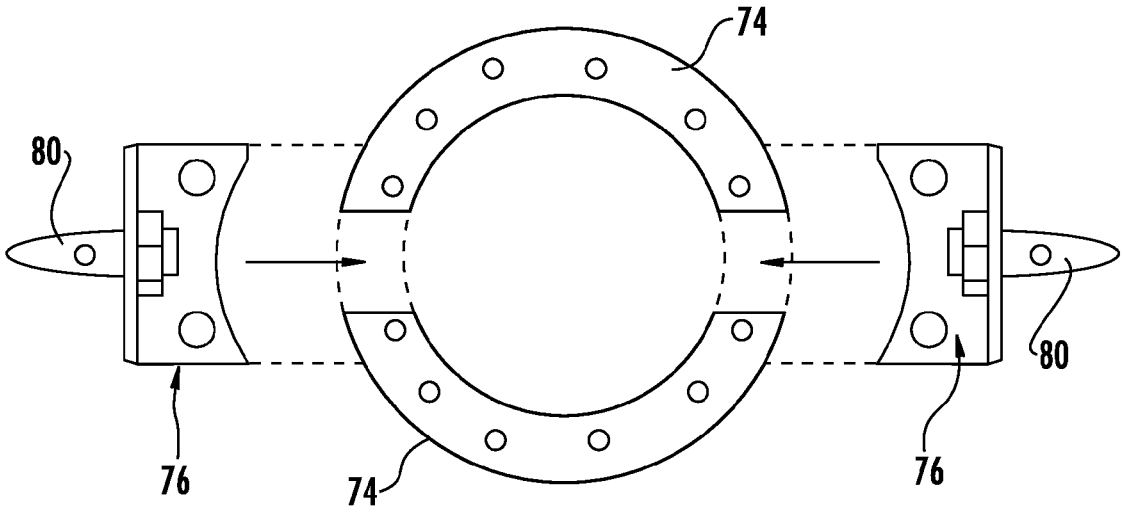
FIG. 6 is a partial plan view of support elements useful with embodiment of the present invention.

With reference to FIG. 6, and again to FIGS. 1 and 2, attaching the frame 22 may include using arcuate plates 74 and tie bar brackets 76 secured to the flange 14 through a biasing against a tank side surface of the flange using well known nuts and bolts or pegs, depending on the style flange carried by the tank. Once secured to the flange, the tie bars 78 are attached to the brackets 76, using pins 80, by way of example. It is to be understood that alternate embodiment will come to the mind of those skilled in the art now having the benefit of the teachings of the present invention.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method of removing a cover from a flange secured about an opening in a tank for safely controlling a flow of material stored within the tank through the opening, wherein the cover is secured to the flange by a plurality of pegs extending into the flange through apertures in the cover, the method comprising:

vacating at least a portion of the plurality of pegs;

rigidly attaching a frame to the flange proximate the opening using at least a portion of the apertures previously vacated by a portion of the plurality of pegs;

attaching an actuator to the frame;

extending an arm between the frame and the cover;

connecting a proximal end of the arm to the actuator and connecting a distal end to the cover;

operating the actuator for forcing the arm against the cover with sufficient force for preventing the cover from being dislodged from about the opening;

unsecuring the cover from about the opening; and controlling the actuator for moving the cover from a closed position to an open position through a spacing therewith, wherein a distance for the spacing controls the flow of material from the tank.

2. A method according to claim 1, further comprising a guide element, wherein the method comprises positioning the guide element for operably guiding the cover longitudinally outward from the opening along the arm.

3. A method according to claim 1, wherein a the flange fully extends about a periphery of the opening, and wherein the method comprises removably attaching the cover to the flange.

4. A method according to claim 1, wherein the frame positioning comprises attaching the frame to the tank.

5. A method according to claim 1, wherein the actuator controlling comprises remotely controlling the actuator.

6. A method according to claim 1, wherein the distal end connecting comprises welding the arm to the cover.

7. A method according to claim 1, wherein the distal end connecting comprises attaching a plate to the arm distal end and attaching the plate to a surface of the cover.

8. A method according to claim 1, further comprising extending a shield substantially about the opening for confining the material exiting the opening.

9. A method according to claim 1, further comprising positioning a container proximate the opening and collecting the material in the container.

10. A method according to claim 9, further comprising removing the material from the container.

11. A method according to claim 10, wherein the material removing comprises pumping.

12. A method according to claim 11, wherein the pumping comprises an auger.

13. A method according to claim 1, further comprising processing the material for improving a fluid flow thereof.

14. A method of removing a cover secured to a flange about an opening in a tank by a plurality of fasteners extending through apertures in the cover and into the flange, the method comprising:

vacating at least a portion of the plurality of fasteners;

securing a frame proximate the opening using at least a portion of the apertures previously vacated by the portion of the plurality of fasteners;

attaching an actuator to the frame;

connecting an arm between the actuator and the cover;

operating the actuator for biasing the cover against the tank with sufficient force for preventing the cover from being dislodged therefrom;

removing the fasteners from engagement with the cover;

securing a guide pin for guiding a removing of the cover; and remotely controlling the actuator for moving the cover from the opening through a controlled spacing therefrom, thus controlling the flow of material from the tank.

15. A method according to claim 14, wherein the flange is carried by the tank about fully a periphery of the opening, and wherein the method comprises removably attaching the cover to the flange by the fasteners, wherein the fasteners comprise at least one of threaded studs, nuts, and bolts.

16. A method according to claim 15, further comprising elongate rods, wherein the guide pin securing comprises removing at least two fasteners from opposing sides of the cover and attaching the elongate rods in place of removed fasteners resulting from the fastener removing from engagement with the cover.

17. A method according to claim 15, wherein the frame positioning comprises rigidly attaching the frame to the flange.

18. A method according to claim 14, wherein the arm connecting comprises attaching a plate to the arm and attaching the plate to a surface of the cover.

19. A method according to claim 14, further comprising extending a shield about the opening for confining at least a portion of the material passing from the tank through the opening.

20. A method according to claim 14, further comprising:

positioning a container for collecting material flowing from the tank through the opening;

collecting the material in the container;

processing the material for improving a fluid flow thereof; and pumping the processed material from the container.

21. A method according to claim 20, wherein the processing comprises chopping the material.

22. A method of removing a manway cover from a flange extending about an opening in a storage tank, wherein the manway cover is secured to the flange by a plurality of pegs extending through apertures in the cover for securing the cover to the flange, the method comprising:

removing a first portion of the plurality of pegs for exposing first apertures therein while maintaining the cover secured to the flange;

rigidly attaching a frame to the flange using the first apertures for a fastening therewith;

attaching an actuator to the frame;

operably connecting an arm for engagement between the cover and the actuator;

operating the actuator for providing sufficient force against the manway cover for preventing the manway cover from being dislodged from the flange;

removing a second portion of the plurality of pegs for exposing second apertures;

securing at least two guide pins to the flange for movement through the second apertures for guiding a removing of the manway cover therealong;

removing a balance of the plurality of pegs; and controlling the actuator for moving the cover from a closed position to an open position through a spacing therewith longitudinally outward along the guide pins, wherein spacing the cover from the flange and thus the opening controls the flow of material through the opening.

23. A method according to claim 22, further comprising extending a containment shield about the flange for confining the material passing through the opening.

24. A method according to claim 22, further comprising:

positioning a container for collecting the material flowing from the tank through the opening;

collecting the material in the container;

processing the material for improving a fluid flow thereof; and pumping the processed material from the container.

25. A method according to claim 24, wherein the processing comprises chopping the material.

* * * * *